US007409927B2

(12) United States Patent
Wenderoth et al.

(10) Patent No.: US 7,409,927 B2
(45) Date of Patent: Aug. 12, 2008

(54) METHOD AND DEVICE FOR COOLING AN INTERNAL COMBUSTION ENGINE

(75) Inventors: Bernd Wenderoth, Birkenau (DE); Stefan Dambach, Haβloch (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/512,092

(22) PCT Filed: May 16, 2003

(86) PCT No.: PCT/EP03/05174

§ 371 (c)(1),
(2), (4) Date: Oct. 21, 2004

(87) PCT Pub. No.: WO03/098015

PCT Pub. Date: Nov. 27, 2003

(65) Prior Publication Data

US 2005/0166870 A1 Aug. 4, 2005

(30) Foreign Application Priority Data

May 17, 2002 (DE) ..... 102 22 102

(51) Int. Cl.
*F01P 11/06* (2006.01)

(52) U.S. Cl. ..... 123/41.01; 123/41.42

(58) Field of Classification Search ..... 123/41.01, 123/41.42

See application file for complete search history.

(56) References Cited

U.S. PATENT DOCUMENTS

| | | | | |
|---|---|---|---|---|
| 4,333,850 | A * | 6/1982 | Krueger | 252/389.2 |
| 4,404,113 | A * | 9/1983 | Peters et al. | 252/75 |
| 4,610,222 | A * | 9/1986 | Goddard et al. | 123/41.42 |
| 5,009,848 | A * | 4/1991 | Secretarski et al. | 422/62 |
| 5,454,967 | A | 10/1995 | Pfitzner et al. | |
| 6,045,719 | A | 4/2000 | Meszaros et al. | |
| 6,080,331 | A | 6/2000 | Meszaros et al. | |
| 6,101,988 | A * | 8/2000 | Evans | 123/41.5 |
| 6,408,688 | B2 | 6/2002 | Dahm et al. | |
| 6,689,289 | B1 * | 2/2004 | Maes et al. | 252/76 |
| 6,748,906 | B1 * | 6/2004 | White et al. | 123/41.01 |
| 2002/0017491 | A1 | 2/2002 | Haddock | |

FOREIGN PATENT DOCUMENTS

| | | |
|---|---|---|
| CA | 2 389 048 A1 | 5/2001 |
| DE | 198 03 884 A1 | 9/1999 |
| DE | 199 38 614 A1 | 2/2001 |
| DE | 101 04 771 A1 | 8/2002 |
| EP | 0 038 556 | 10/1981 |
| GB | 1 168 480 A | 10/1969 |

(Continued)

*Primary Examiner*—Stephen K. Cronin
*Assistant Examiner*—Jason Benton
(74) *Attorney, Agent, or Firm*—Nixon & Vanderhye P.C.

(57) ABSTRACT

The invention relates to a method and a device for cooling an internal combustion engine. An aqueous, non-ionic coolant composition is used in a cooling circuit (14) of the internal combustion engine (11). In order to also ensure long-lasting protection against corrosion for light metal components of the engine that come into contact with the coolant, e.g. components made of magnesium or magnesium alloys, the cooling circuit has at least one deionization device (28), for example, an ion exchanger, for the coolant.

13 Claims, 1 Drawing Sheet

FOREIGN PATENT DOCUMENTS

| | | | |
|---|---|---|---|
| JP | 401125517 A | * | 5/1989 |
| JP | 04 101015 A | | 4/1992 |
| JP | 06 093856 A | | 4/1994 |
| WO | WO 00 17951 A1 | | 3/2000 |
| WO | WO 02 08354 A1 | | 1/2002 |

* cited by examiner

METHOD AND DEVICE FOR COOLING AN INTERNAL COMBUSTION ENGINE

This application is the US national phase of international application PCT/EP03/05174 filed 16 May 2003 which designated the U.S. and claims benefit of DE 102 22 102.2, dated 17 May 2002, the entire content of which is hereby incorporated by reference.

The present invention relates to a method and an apparatus for cooling an internal combustion engine, and a fuel-burning engine unit comprising an internal combustion engine and a corresponding cooling apparatus.

Fuel-burning engine units, for example fuel-burning engine units for motor vehicles, usually have an internal combustion engine and a cooling circulation in which a cooling liquid circulates.

Different cooling circulations of such fuel-burning engine units are described, for example, in European Patent Application EP-A 0 038 556 or in German Patent Applications DE-A 198 03 884, DE-A 199 38 614 or DE-A 199 56 893. Circulating in the cooling circulation of these fuel-burning engine units is a cooling liquid which is passed through cooling jackets in the engine block/crank case and in the cylinder head. The cooling liquid is generally first passed through the cooling jacket of the crank case and then through the cooling jacket of the cylinder head. However, it is also possible to divide the cooling liquid by means of a preferably controllable valve before the entrance into the engine housing into two separate part-circulations and to pass them separately into the cooling jackets of crank case and cylinder head. By a control means, it is then possible to regulate the two partial cooling circulations depending on parameters of the internal combustion engine, if necessary independently of one another.

Coolant concentrates which are diluted with water and ensure on the one hand good heat removal and, on the other hand, reliable protection from freezing are used as cooling liquids which circulate in the cooling circulations. The coolants generally intended for cooling circulations of internal combustion engines contain alkylene glycols, especially ethylene glycol or propylene glycols, as a main component. Alkylene glycol/water mixtures are, however, very corrosive at the operating temperatures of internal combustion engines. The different metals occurring in the cooling system, for example copper, brass, iron, steel, cast iron (gray cast iron), lead, tin, chromium, zinc and aluminum and alloys thereof, and solder metals, for example tin solder (soft solder), must therefore be adequately protected from the various types of corrosion, for example pitting, crevice corrosion, erosion or cavitation. For this reason, coolants for the cooling circulations of internal combustion engines also contain corrosion inhibitors in addition to the antifreezes.

Typical coolant formulations, as described, for example, in WO-A 01/32801, EP-A 0 816 467, WO-A 97/30133 or EP A 0 557 761, therefore also contain ionic corrosion inhibitors in the form of organic carboxylic acid salts, such as alkali metal salts of 2-ethylhexanoic acid or sebacic acid, and/or in the form of inorganic salts, such as nitrates, nitrites, borates or molybdates.

In automobile construction, it is now desirable to reduce the fuel consumption by weight reduction in motor vehicles. In engine construction too, there is therefore interest in reducing the weight of the unit, for example, by using light metals or light metal alloys. Thus, for example in recent developments, attempts are being made to construct engines partly or completely from magnesium or magnesium alloys.

It has been found that, owing to the increased chemical reactivity of magnesium, the coolants commercially available today and containing ionic corrosion inhibitors offer virtually no corrosion protection for components comprising magnesium and alloys thereof.

International Patent Application WO-A 02/08354 of the Applicant describes for the first time completely nonionic coolant concentrates and aqueous coolant compositions containing these coolant concentrates. These are coolants comprising antifreeze components based on alkylene glycols and derivatives thereof or on glycerol, which contain from 0.05 to 10% by weight of one or more carboxamides and/or sulfonamides, if required in addition to other corrosion inhibitors, with the result that very good corrosion protection is achieved, in particular in the case of light metals, such as aluminum and magnesium, or alloys thereof.

At the operating temperatures of internal combustion engines, however, corrosive ionic decomposition products can also form in such nonionic coolant compositions. Moreover, the cooling circulation of an internal combustion engine is generally not a hermetically sealed system, so that corrosive pollutants may also be introduced, for example when replenishing cooling water.

International Patent Application WO-A 00/17951 describes a cooling system for fuel cells, in which a pure ethylene glycol/water mixture without corrosion inhibitors is used as the coolant. In order to ensure both the purity of the coolant over a relatively long period and a low specific conductivity, an ion exchanger unit is arranged in the cooling circulation of the fuel cell. However, WO-A 00/17951 does not mention internal combustion engines with their specific material problems, for example with regard to the use of the components comprising light metal alloys, nor is this document concerned with the problems of cooling liquids which contain corrosion inhibitors.

It is an object of the present invention to provide a method for cooling internal combustion engines which offers very good and long-lasting corrosion protection in particular for light metals and light metal alloys at the operating temperatures prevailing in an internal combustion engine. It is furthermore an object of the present invention to provide an apparatus suitable for carrying out the novel method.

We have found that this object is achieved by the method as claimed in present claim 1. Advantageous further developments of the novel method form the subject of the dependent claims. The invention proposes using at least one deionizing means in the cooling circulation of a fuel-burning engine unit. In the case of conventional coolant compositions which contain ionic corrosion inhibitors, the use of a deionizing means would prevent effective corrosion protection. The invention therefore also proposes using the deionizing means in combination with a nonionic coolant composition.

The present invention accordingly relates to a method for cooling internal combustion engines, a cooling liquid which comprises nonionic corrosion inhibitors being allowed to circulate in a cooling circulation in thermal contact with the internal combustion engine, and the cooling liquid being at least intermittently deionized. We have found surprisingly that, by the intermittent or continuous deionization of the cooling liquid in the cooling circulation, the ionic impurities formed during operation can be removed from the cooling liquid and long-lasting corrosion protection is thus ensured. By the use of nonionic corrosion inhibitors, the novel process is suitable in particular for cooling internal combustion engines which contain light metal components, in particular components comprising aluminum or magnesium or alloys thereof.

All aqueous coolant compositions comprising nonionic corrosion inhibitors, in particular those as described, for example, in WO-A 02/08354 of the Applicant, are particularly suitable for use as cooling liquid in the novel method.

Radiator protection formulations based on water or based on water in combination with liquid alcoholic freezing point depressants can be used. Suitable liquid alcoholic freezing point depressants are alkylene glycols and derivatives thereof, and glycerol, in particular propylene glycol and especially ethylene glycol. However, higher glycols and glycol ethers are also suitable, for example diethylene glycol, dipropylene glycol and monoethers of glycols, such as methyl, ethyl, propyl and butyl ethers of ethylene glycol, propylene glycol, diethylene glycol and dipropylene glycol. Mixtures of said glycols and glycol ethers and mixtures of these glycols with glycerol and, if required, with said glycol ethers may also be used.

The antifreeze and corrosion inhibitor composition usually present as a concentrate before mixing with water preferably contains from 0.05 to 10% by weight, based on the total amount of the concentrate, of one or more carboxamides and/or sulfonamides, particularly preferably one or more aliphatic, cycloaliphatic, aromatic or heteroaromatic carboxamides and/or sulfonamides of in each case 2 to 16, in particular in each case 3 to 12, carbon atoms. The amides may be unsubstituted or alkyl-substituted on the nitrogen atom of the amido group, for example by C1-C4-alkyl. Aromatic or heteroaromatic skeletons of the molecule can of course also carry alkyl groups. One or more, preferably one or two, amido groups may be present in the molecule. The amides may additionally carry functional groups, preferably C1-C4-alkoxyamino, chlorine, fluorine, hydroxyl and/or acetyl, such functional groups being present in particular as substituents on aromatic or heteroaromatic rings present. Particularly preferred aromatic carboxamides, heteroaromatic carboxamides, aliphatic carboxamides, cycloaliphatic carboxamides having the amido group as part of the ring and aromatic sulfonamides are described in detail in WO-A 02/08354.

Furthermore, the concentrate may contain aliphatic, cycloaliphatic or aromatic amines of 2 to 15 carbon atoms, mononuclear or dinuclear saturated or partly unsaturated heterocycles of 4 to 10 carbon atoms and/or tetra(C1-C8-alkoxy) silanes. Examples of said additional components are likewise described more specifically in WO-A 02/08354.

Further corrosion inhibitors and other assistants, such as antifoams, markers and bitter substances may also be present in conventional small amounts for reasons of hygiene and safety in case of swallowing, provided that these are nonionic components.

The cooling liquid comprises from 10 to 90% by weight of water and from 90 to 10% by weight of the coolant concentrate as a ready-to-use aqueous cooling liquid, in particular for radiator protection of cooling circulations for internal combustion engines.

The cooling liquid is preferably deionized chemically with the aid of ion exchangers and/or liquid deionizing agents and/or by an electrochemical method.

The present invention also relates to an apparatus for cooling an internal combustion engine, in particular for carrying out the novel method, the apparatus comprising a cooling circulation which is in thermal contact with the internal combustion engine at least in a section. In the novel apparatus, at least one deionizing means for a cooling liquid is arranged in the cooling circulation. Preferably, ion exchangers and/or liquid deionizing agents and/or means for continuous electrochemical deionization are used as the deionizing means.

The deionizing means can be arranged at any suitable point in the cooling circulation of the internal combustion engine, for example in the main cooling circulation, so that the deionizing means comes into direct contact with the cooling liquid stream, or in a bypass stream through which only a portion of the cooling liquid is pumped per unit time, or in a compensating vessel usually provided in the cooling circulation, or in its discharge to the cooling circulation.

If an ion exchanger is used as the deionizing means, it is preferably contained in a filter cartridge which can be easily changed and replaced as required, for example when the ion exchanger is exhausted.

Suitable ion exchangers for deionizing liquids are known per se. In the novel process, organic ion exchangers are preferably used, in particular mixed products comprising anion exchanger resins of the strongly alkaline hydroxyl type and/or sulfo-based cation exchange resins. A corresponding commercially available combination product is, for example, a mixed-bed resin ion exchanger AMBERJET® UP 6040 RESIN from Rohm & Haas.

Furthermore, active carbons or inorganic adsorbents, such as aluminas, silica gels, zeolites or clay minerals, such as the solid-state acids (H-clays), for example MONTMORRILONIT®, can be used as ion exchangers for this purpose. A commercially available product is, for example, MONTMORRILONIT® KSF from Fluka.

Liquid deionizing agents which may be used are liquids which are known per se and are capable of binding ions. The bond may be achieved by complexing, as, for example, in the case of known complexing agents. Examples of such compounds are sugar acids, citric acids, tartaric acid, nitrilotriacetic acid (NTA), methylglycinediacetic acid (MGDA), ethylenediaminetetraacetic acid (EDTA) and further polyaminopolycarboxylic acids, for example polyaminopolyphosphinic acids. If the complexing compounds are solids per se, the liquid deionizing agent is a solution of these compounds in a liquid which may be miscible or immiscible with the cooling medium. The binding of the ions can also be effected by ionic interaction. This may be the case, for example, with the use of amines, quaternized amines or polyamines, such as polyethyleneimine or polyvinylamine. Mixtures of a complexing agent with a compound which acts via ionic interactions are also possible, for example also solutions of complexing agents in such compounds.

The liquid deionizing agent can be mixed with the cooling medium so that intimate contact between the two media is ensured. The deionizing agent is then separated off again from the cooling medium, for example by phase separation by means of a phase separator or by a membrane cell. If a liquid deionizing agent which is immiscible with the circulating cooling liquid is used, according to a second variant it can be brought into contact with the cooling liquid either directly or via a membrane, in particular an ion-permeable membrane. If the deionizing agent is substantially immiscible with the cooling liquid, bringing into contact can be effected in a container which contains the deionizing agent and through which a cooling medium forming a second phase flows. In German Patent Application DE-A 102 01 276 of the Applicant, the use of liquid deionizing agents in a cooling system for fuel cells is described in more detail.

According to a further variant, the cooling liquid is electrochemically deionized, preferably by electrodialysis. For carrying out the electrodialysis, voltage is applied to the electrodes of an electrochemical cell arranged in the cooling circulation, which voltage removes a part of the ions from the cooling circulation. Electrodialysis cells which can be operated with or without ion exchangers are preferably used. If ion exchangers are used, the corresponding cells are also referred to as electrodeionization cells. By using ion exchangers, a residual conductivity of the cooling medium which is substantially lower than in the case of pure electrodialysis can be achieved. Preferably used deionizing means are therefore electrodeionization cells. There, the cooling medium is passed as a diluate stream through the cell. Electrodeionization cells are known per se and are used, for example, for the desalination of sea water. Such a cell may consist of a mixed bed of anion and cation exchanger resins. According to a further variant, anion and cation exchanger resins are arranged in two separate chambers. The diluate stream flows through the ion exchanger packings, and said packings are separated from the concentrate stream by ion-selective membranes. A detailed description of a method and of an apparatus for the electrochemical deionization of the cooling liquid of a fuel cell appears in German Patent Application DE-A 101 04 771 of the Applicant.

The present invention finally also relates to a liquid-cooled fuel-burning engine unit comprising at least one internal combustion engine and at least one cooling circulation for the internal combustion engine, wherein at least one deionizing means is provided in the cooling circulation.

The invention is explained in more detail below with reference to an embodiment shown in the attached drawings.

Figure 1:
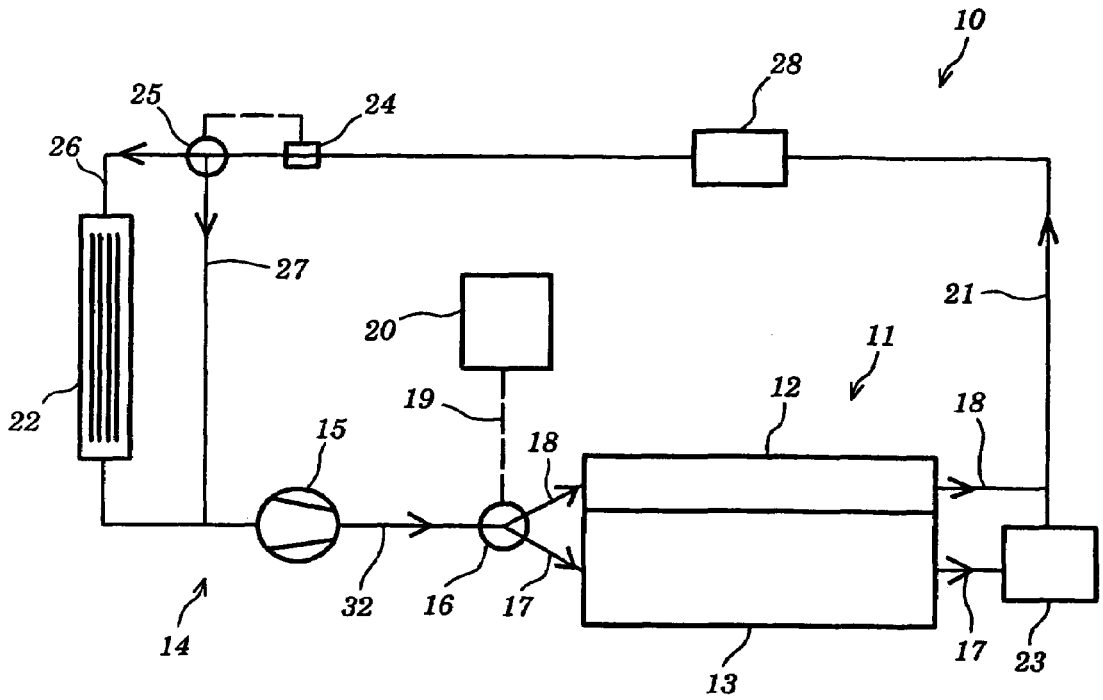
FIG. 1 shows a schematic diagram of the novel fuel-burning engine unit having a deionizing means arranged in a cooling circulation.

FIG. 1 schematically shows a novel fuel-burning engine unit 10.

The fuel-burning engine unit 10 comprises an internal combustion engine 11, which has a cylinder head 12 and an engine block or a crank case 13, and a cooling circulation 14 in which an aqueous, nonionic coolant composition is circulated by means of a cooling water pump 15. In the example shown, the cooling liquid, starting from the cooling water pump 15, passes through a distributor 16 which divides it into two cooling channels 17, 18, the division ratio in the distributor 16 being controllable. The control signal is delivered via a line 19 from a control unit 20 which measures the temperature of the cylinder head 12 and of the crank case 13 or of the cooling liquid emerging from the lines 17 or 18 from the internal combustion engine 11 by means of sensors (not shown) and sets the division ratio so that none of these temperatures exceeds a predetermined maximum. After their emergence from the cylinder head 12 and the crank case 13, the cooling lines 17, 18 are combined to form a return line 21 which carries the hot cooling liquid to a heat exchanger 22 which, in a motor vehicle, is referred to as a radiator. Before the two lines 17, 18 are combined, the crank case cooling line 17, which usually has a higher throughput and a higher exit temperature, can be passed through a heating heat exchanger 23, where heat for heating the passenger compartment of a motor vehicle can be withdrawn from the cooling liquid. Before the hot cooling liquid reaches the heat exchanger/radiator 22, it can be divided by a mixer 25 regulated by a thermostat 24 into a first part-stream leading via a line 26 to the radiator 22 and a second part-stream which bypasses the radiator via a bypass line 27. The two part-streams are combined again after the first part-stream has passed through the radiator 22, and return to the cooling water pump 16.

In the example shown, a deionizing means 28 provided according to the invention, for example a changeable filter cartridge with an ion exchanger resin, is arranged in the return line 21. In the variant of FIG. 1, when an ion exchanger is used, the cooling liquid circulating in the cooling circulation 14 is continuously deionized. After exhaustion of the ion exchanger, the filter cartridge can be replaced. The deionizing means 28 can, however, also be in the form of an electrochemical deionization cell or in the form of a contact cell for a liquid deionizing agent.

Figure 2:
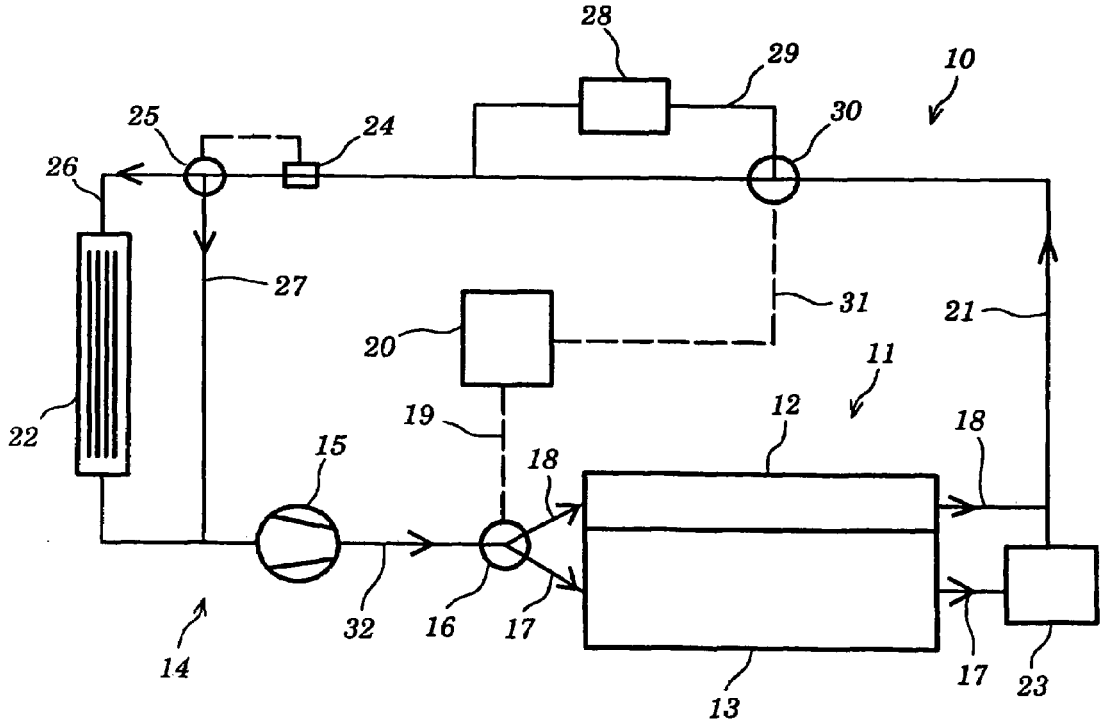
FIG. 2 shows a variant of the arrangement of the deionizing means in the cooling circulation of FIG. 1.

In the variant shown in FIG. 2, the deionizing means 28 is arranged in a bypass 29, a valve 30 being used to control when and which amount of the coolant stream is deionized in the bypass branch 29. The valve 30 can be controlled by the control means 20, for example via a signal line 31 as a function of the values delivered by a conductivity cell (not shown) arranged in the cooling circulation 14. In this case, deionization of the cooling liquid is effected only when an increase in the concentration of the ionic constituents of the cooling liquid is registered via the conductivity cell. The other components of the variant of FIG. 2 which correspond to those of the variant of FIG. 1 are denoted by the same reference numerals as in FIG. 1.

Of course, the deionizing means provided according to the invention can be arranged at any suitable point in the cooling circulation 14, for example in a line section 32 after passing through the radiator 22 or in the bypass line 27.

COMPARATIVE EXAMPLES

For comparative experiments for the standard corrosion test according to ASTM D 1384-94, an ASTM D 1384 test apparatus was supplemented so that the cooling liquid was circulated with the aid of a commercial PKW cooling water pump (from Bosch type PAA 12V 0 392 020 057, 12 V DC voltage, maximum pump delivery 260 liters per hour) via PVC hoses through a glass filter funnel with frits, in which 75 g of the ion exchanger AMBERJET® UP 6040 RESIN (Rohm & Haas) were present. The experiments were each carried out three times with and without ion exchangers.

The nonionic radiator protection formulation used is a mixture of 30% by weight of distilled water, 60% by weight of monoethylene glycol, 1% by weight of p-toluenesulfonamide, 0.5% by weight of triethanolamine and 0.5% by weight of tolutriazole (example 15 from WO-A 02/08354).

COMPARATIVE EXAMPLE 1

For a first comparative test, a standard metal set according to ASTM D 1384 and additionally, apart from the aluminum coupon, a magnesium coupon of the alloy Mg AZ91HP were used in both experiments.

The mean values of three experiments in each case with and without ion exchanger in the cooling circulation are shown in table 1 below:

TABLE 1

| Test specimen | without ion exchanger Weight change [mg/cm$^2$] | with ion exchanger Weight change [mg/cm$^2$] |
|---|---|---|
| Copper | −0.23 | 0.00 |
| Soft solder | −3.13 | +0.01 |
| Brass | −0.24 | 0.00 |
| Steel | 0.00 | −0.03 |
| Gray cast | +0.01 | −0.09 |
| Cast aluminum | +0.01 | +0.06 |
| Magnesium AZ91HP | −6.70 | −1.59 |

Experiment 2:

In experiment 2, corresponding comparative tests with the ASTM standard metal set without additional magnesium coupon were carried out. The mean values of three experiments in each case with and without ion exchanger in the cooling circulation are shown in table 2 below.

TABLE 2

| Test specimen | without ion exchanger Weight change [mg/cm$^2$] | with ion exchanger Weight change [mg/cm$^2$] |
|---|---|---|
| Copper | −0.16 | −0.03 |
| Soft solder | −2.51 | −1.11 |
| Brass | −0.17 | −0.05 |
| Steel | +0.02 | −0.01 |
| Gray cast | +0.04 | −0.02 |
| Cast aluminum | +0.03 | −0.00 |

It is evident that the corrosion protection of nonionic radiator protection formulations can be further improved by using an ion exchanger in the cooling circulation. A particularly pronounced improvement in the corrosion protection is found in the case of the components comprising magnesium and its alloys, in particular in combination with nonferrous metals, such as copper or brass or soft solder.

We claim:

1. A method for cooling an internal combustion engine, comprising allowing a cooling liquid which comprises nonionic corrosion inhibitors to circulate in a cooling circulation in thermal contact with the internal combustion engine, measuring conductivity of the cooling liquid and deionizing the cooling liquid when an increase of the conductivity is detected.

2. A method as claimed in claim 1, wherein the cooling liquid is an aqueous coolant composition which comprises from 10 to 90% by weight of a coolant concentrate based on alkylene glycols or derivatives thereof or on glycerol, the coolant concentrate containing from 0.05 to 100/0 by weight, based on the total amount of concentrate, of one or more carboxamides and/or sulfonamides, if required in addition to further nonionic components.

3. A method as claimed in claim 1, wherein the cooling liquid is deionized by means of at least one ion exchanger.

4. A method as claimed in claim 1, wherein the cooling liquid is deionized by means of a liquid deionizing agent.

5. A method as claimed in claim 1, wherein the cooling liquid is deionized electrochemically.

6. A liquid-cooled fuel-burning engine unit comprising:

an internal combustion engine, at least one cooling circulation having a cooling liquid which comprises nonionic corrosion inhibitors, at least one deionizing means for the cooling liquid which is arranged in said cooling circulation and being in thermal contact with at least a section of the internal combustion engine, and means for measuring conductivity of the cooling liquid coupled with the at least one deionizing means such that the cooling liquid is deionized when an increase of the conductivity is measured.

7. Fuel-burning engine as claimed in claim 6, wherein the deionizing means comprises at least one ion exchanger.

8. Fuel-burning engine as claimed in claim 6, wherein the deionizing means comprises a contact cell in which a liquid deionizing agent can act on the cooling liquid.

9. Fuel-burning engine as claimed in claim 6, wherein the deionizing means comprises at least one electrodialysis cell.

10. Fuel-burning engine as claimed in claim 9, wherein the electrodialysis cell comprises an ion exchanger.

11. Fuel-burning engine as in claim 7, wherein the at least one ion exchanger comprises a mixed bed resin ion exchanger.

12. Fuel-burning engine as in claim 6, wherein the engine is constructed at least partly from magnesium or magnesium alloys.

13. A method as claimed in claim 1, wherein the engine is constructed at least partly from magnesium or magnesium alloys.

* * * * *